US007930841B2

(12) United States Patent
Luedecke et al.

(10) Patent No.: US 7,930,841 B2
(45) Date of Patent: Apr. 26, 2011

(54) ARTICLE OF FOOTWEAR FOR WATER SPORTS

(75) Inventors: Tom Luedecke, Portland, OR (US); Sean M. McDowell, Portland, OR (US); Julia Roether, Portland, OR (US)

(73) Assignee: Nike, Inc., Beaverton, OR (US)

( * ) Notice: Subject to any disclaimer, the term of this patent is extended or adjusted under 35 U.S.C. 154(b) by 799 days.

(21) Appl. No.: 11/862,885

(22) Filed: Sep. 27, 2007

(65) Prior Publication Data

US 2009/0083994 A1 Apr. 2, 2009

(51) Int. Cl.

| | |
|---|---|
| ***A43B 5/08*** | (2006.01) |
| ***A43B 13/00*** | (2006.01) |
| ***A43B 3/00*** | (2006.01) |
| ***A43C 11/00*** | (2006.01) |

(52) U.S. Cl. ..... 36/113; 36/8.1; 36/58.5; 36/59 C; 36/50.1; D2/903

(58) Field of Classification Search ..... 36/50.1, 36/7.3, 7.4, 51, 110, 11.5, 89, 113, 58.5, 36/58.6, 59 C; D2/903, 960, 951, 954, 956, D2/957

See application file for complete search history.

(56) References Cited

U.S. PATENT DOCUMENTS

| | | | | |
|---|---|---|---|---|
| 1,637,027 | A | | 7/1927 | Piper |
| 1,717,127 | A | | 6/1929 | Toole |
| D117,585 | S | | 11/1939 | Sperry |
| 2,933,831 | A | | 4/1960 | Le Compte |
| 4,231,170 | A | | 11/1980 | Griswold |
| 4,567,678 | A | * | 2/1986 | Morgan et al. ..... 36/110 |
| 4,649,656 | A | | 3/1987 | Cox et al. |
| 4,707,874 | A | | 11/1987 | Champagne |
| 4,756,026 | A | | 7/1988 | Pierce, Jr. |
| 4,793,075 | A | | 12/1988 | Thatcher |
| D321,084 | S | | 10/1991 | Miller et al. |
| 5,176,624 | A | * | 1/1993 | Kuehnreich ..... 602/65 |
| 5,245,767 | A | | 9/1993 | Morin |
| D342,145 | S | | 12/1993 | Yeh |
| D349,601 | S | | 8/1994 | Buck, IV |
| D350,021 | S | | 8/1994 | Stein |
| D384,490 | S | | 10/1997 | Bryant |
| D385,102 | S | | 10/1997 | Avar |
| 5,699,629 | A | * | 12/1997 | Munschy ..... 36/97 |
| 5,711,092 | A | | 1/1998 | Despres et al. |
| 5,778,565 | A | * | 7/1998 | Holt et al. ..... 36/110 |
| 5,878,512 | A | | 3/1999 | Cooper et al. |
| 5,913,592 | A | | 6/1999 | Moore |
| D414,317 | S | * | 9/1999 | Lubart ..... D2/951 |

(Continued)

FOREIGN PATENT DOCUMENTS

JP 6165704 6/1994

(Continued)

OTHER PUBLICATIONS

Office Action mailed Jul. 12, 2010 in U.S. Appl. No. 11/862,863.

(Continued)

*Primary Examiner* — Jila M Mohandesi
(74) *Attorney, Agent, or Firm* — Plumsea Law Group, LLC

(57) ABSTRACT

An article of footwear for water sports, especially canoeing, is disclosed. The article of footwear includes an upper attached to a sole forming a first live hinge and a strap system attached to the sole forming a second live hinge. The second live hinge is disposed distally from the first live hinge.

20 Claims, 8 Drawing Sheets

U.S. PATENT DOCUMENTS

| | | | | | |
|---|---|---|---|---|---|
| 5,950,333 | A | | 9/1999 | Tsen | |
| D415,610 | S | * | 10/1999 | Cahill | D2/960 |
| D417,943 | S | * | 12/1999 | Solaroli | D2/951 |
| 6,170,174 | B1 | | 1/2001 | Gesso | |
| 6,183,377 | B1 | | 2/2001 | Liang | |
| D456,985 | S | | 5/2002 | Clegg | |
| 6,389,715 | B1 | | 5/2002 | Krajcir | |
| 6,427,363 | B1 | * | 8/2002 | Hunter | 36/100 |
| D473,042 | S | * | 4/2003 | Wilson | D2/960 |
| D476,141 | S | * | 6/2003 | Matis | D2/960 |
| D512,212 | S | | 12/2005 | Hatfield | |
| 7,069,670 | B1 | | 7/2006 | Gerke | |
| 7,082,703 | B2 | | 8/2006 | Greene et al. | |
| 7,107,702 | B1 | | 9/2006 | Chavez | |
| 7,316,082 | B2 | | 1/2008 | Hernande Martinez-Portillo et al. | |
| 7,475,501 | B1 | * | 1/2009 | DeToro et al. | 36/110 |
| 2004/0175064 | A1 | | 9/2004 | Damour | |
| 2008/0098626 | A1 | * | 5/2008 | Wright | 36/136 |

FOREIGN PATENT DOCUMENTS

| | | |
|---|---|---|
| WO | WO 92/15214 | 9/1992 |

OTHER PUBLICATIONS

Office Action mailed Jul. 7, 2010 in U.S. Appl. No. 11/862,874.

* cited by examiner

ARTICLE OF FOOTWEAR FOR WATER SPORTS

BACKGROUND OF THE INVENTION

1. Field of the Invention

The present invention relates generally to footwear and in particular to an article of footwear configured to be worn during water sports, especially canoeing.

2. Description of Related Art

Articles of footwear for use in water sports have been previously proposed. Greene et al. (U.S. Pat. No. 7,802,703) teaches an article of footwear for sand sports. Greene teaches a mid-foot wrap that includes a first portion that extends across the instep of an upper and over an outsole. A second portion of the wrap extends around the rear of the upper and above the heel and below the ankle. Greene further teaches a strap associated with the wrap that has a first end that is secured to the wrap at a medial side. The strap of the Greene design extends across an instep of the upper to a lateral side. A fastener secures the strap to the wrap.

Moore (U.S. Pat. No. 5,913,592) teaches a performance water boot. The Moore design includes a water boot having an adjustable strap that crosses an upper between the instep region and the collar region of the boot. Moore teaches a heel cup that is designed to cooperate with the adjustable strap in order to seal off the heel and ankle regions of the upper. Moore teaches this arrangement to prevent water from entering the instep region and causing the foot to move within the boot.

Moore and Greene teach provisions for providing additional stability to multiple regions of a foot, including a lower region.

SUMMARY OF THE INVENTION

An article of footwear configured for water sports is disclosed. In one aspect, the invention provides an article of footwear configured to provide traction on a wet surface, comprising: a water durable upper and a slip-resistant sole; a strap system comprising a first front strap, a first rear strap, a second front strap and a second rear strap; the first front strap being configured to engage the second front strap at an instep region of a foot and the first rear strap being configured to engaged the second rear strap at the heel of the foot; and where the first front strap is integrally formed with the first rear strap and wherein the second front strap is integrally formed with the second rear strap.

In another aspect, the upper is configured to attach to the sole to form a first live hinge at a first periphery of the sole.

In another aspect, the strap system is configured to attach to the sole at an extended portion and form a second live hinge at a second periphery of the sole.

In another aspect, the second live hinge is disposed distally of the first live hinge.

In another aspect, the first rear strap and the second rear strap may be adjusted independently of the first front strap and the second front strap.

In another aspect, the sole includes channels configured to pump water out from under a bottom portion of the sole.

In another aspect, the invention provides an article of footwear configured to provide traction on a wet surface, comprising: a water durable upper and a slip-resistant sole, the upper being configured to attach to the sole; the upper including a bottom portion configured to attach to the sole and forming a first live hinge at a first periphery of the sole; a strap system configured to attach to an extended portion of the sole and forming a second live hinge at a second periphery of the sole; and where the second live hinge is disposed distally of the first live hinge.

In another aspect, the strap system includes a first front strap, a second front strap, a first rear strap and a second rear strap.

In another aspect, the first front strap is configured to engage the second front strap at an instep region of a foot.

In another aspect, the first rear strap is configured to engage the second rear strap at a heel of the foot.

In another aspect, the first front strap is integrally formed with the first rear strap and the second front strap is integrally formed with the second rear strap.

In another aspect, the sole includes a central contact region.

In another aspect, the sole includes channels configured to remove water from the central contact region.

In another aspect, the invention provides an article of footwear configured to provide traction on a wet surface, comprising: a water durable upper and a slip-resistant sole; the sole including a bottom portion; a central contact region of the bottom portion disposed between a first central channel and a second central channel; a plurality of lateral channels configured to intersect the first central channel and the second central channel; and where the first central channel, the second central channel and the plurality of lateral channels are configured to pump water away from the central contact region.

In another aspect, the bottom portion includes a ball region with a plurality of large recesses configured for removing water from under the bottom portion.

In another aspect, the bottom portion includes a plurality of curved channels configured for removing water from under the bottom portion.

In another aspect, the bottom portion includes a heel portion with U-shaped channels configured for removing water from under the bottom portion.

In another aspect, the upper is made of an elastic material.

In another aspect, the strap system is made of an elastic material.

In another aspect, the upper and the strap system are configured to conform to contours of a foot.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
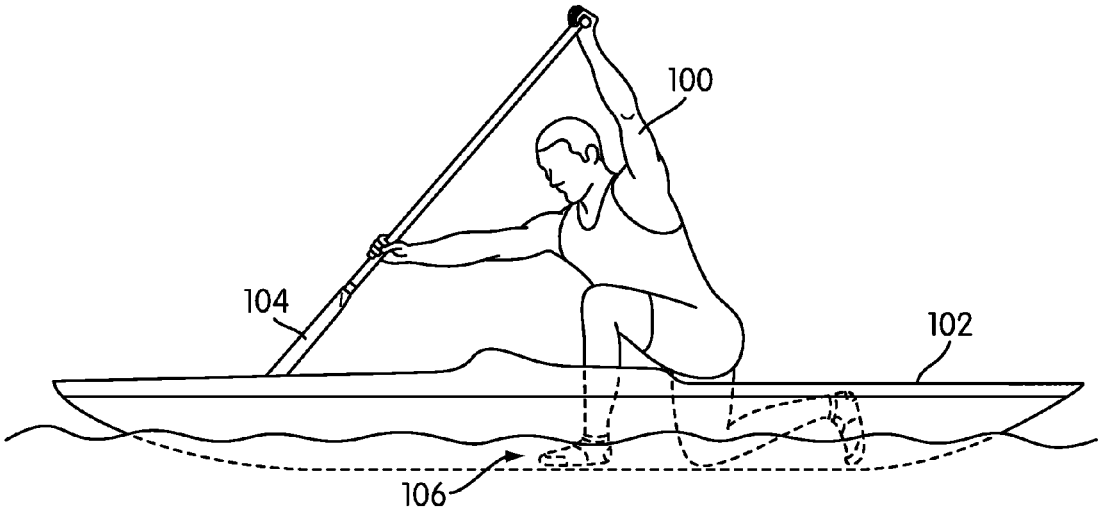
FIG. 1 is a preferred embodiment of an athlete sitting within a boat.

FIG. 1 is a schematic diagram of athlete 100 engaging in a water related activity. In this embodiment, athlete 100 is operating boat 102. The term 'athlete' as used throughout this detailed specification and in the claims refers to anyone capable of operating boat 102 using various provisions such as paddle 104. The term athlete is not meant to be restricted to pro athletes, amateur athletes or any other type of competitors. In some embodiments, athlete 100 may not be competing in any sport or activity.

Preferably, boat 102 is a canoe. However, in other embodiments, boat 102 could be any type of boat that requires paddling. Examples of various boats configured for paddling include, but are not limited to, a row-boat, a kayak or another type of boat. In other embodiments, boat 102 could be any kind of boat, including motor boats, sailing boats, paddle boats or any other type of boat.

In a preferred embodiment, athlete 100 is wearing footwear 106 configured to assist athlete 100 in achieving various tasks associated with paddling. Preferably, article 106 may be adapted for water related activities. Some embodiments of article 106 include provisions that allow article 106 to function successfully in wet or nautical environments. These provisions can include features such as slip-resistant provisions, quick fastening provisions, insulating provisions as well as provisions for increased support. Such provisions are useful because athlete 100 may often be stepping in water, as well as stepping on wet and slippery surfaces. These various provisions will be discussed in the remainder of this detailed description.

Figure 2:
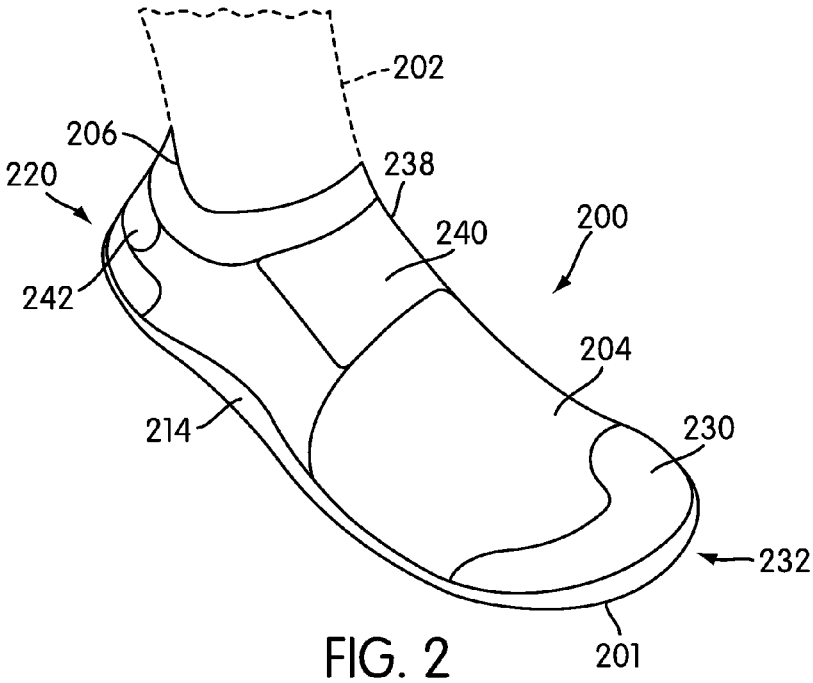
FIG. 2 is an isometric view of a preferred embodiment of an article of footwear.
Figure 3:
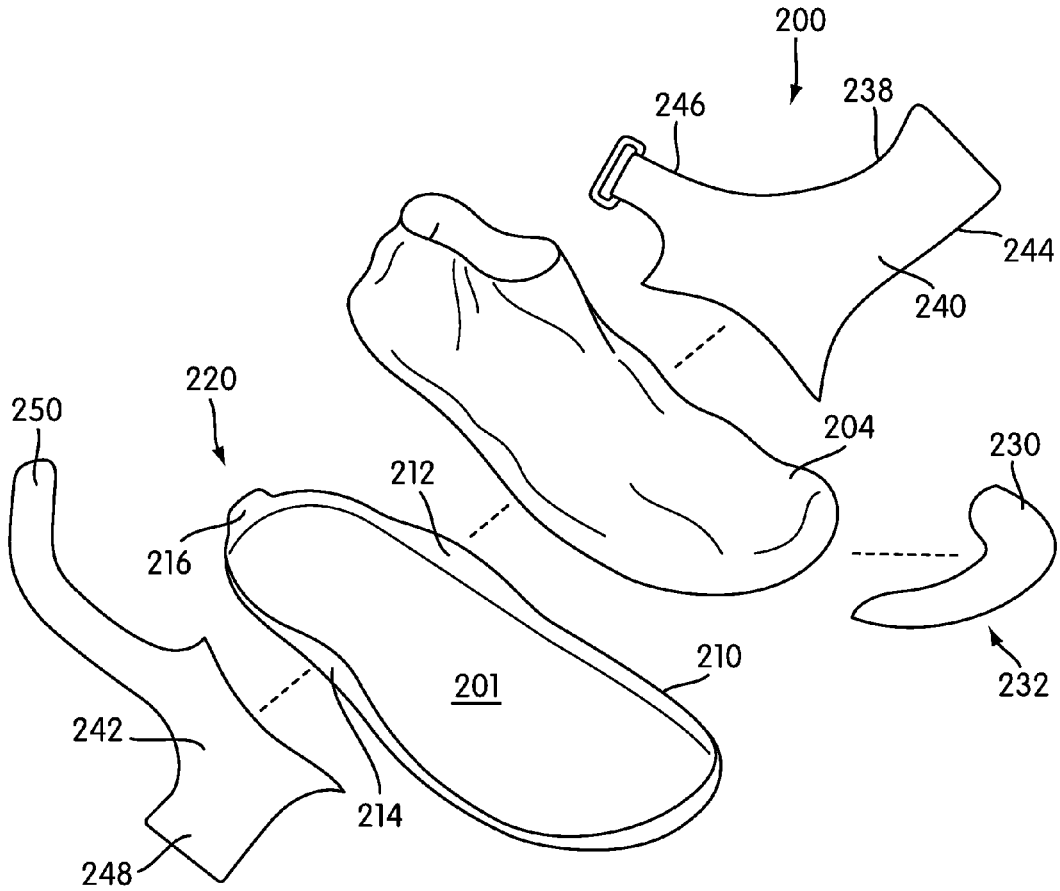
FIG. 3 is an exploded isometric view of a preferred embodiment of an article of footwear.

FIGS. 2-3 are preferred isometric views of article of footwear 200. In this preferred embodiment, article of footwear 200 is a canoe shoe. In other embodiments, article of footwear 200 could be a kayaking shoe, a rowing shoe or another kind of water shoe. In particular, the features of article of footwear 200 that are useful for canoeing may be equally applicable and useful in similar water sports such as those previously discussed here.

Article of footwear 200 includes upper 204. In some embodiments, upper 204 may be made of a soft and elastic material. Examples of such materials include elastic materials and any type of water proof materials. In a preferred embodiment, upper 204 is made of neoprene or a similar material. Using this preferred material, upper 204 may be configured to provide insulation to foot 202 during use. More generally, upper 204 may be made of a water durable material. The term 'water durable' is used throughout this detailed specification and in the claims to refer to any material that is not affected by extended exposure to water. This is useful feature because article of footwear 200 may get wet many times during canoeing or similar water activities.

Furthermore, this general lightweight construction for upper 204 provides for extreme flexibility. When foot 202 is inserted, upper 204 conforms to the shape of foot 202 by expanding. However, as foot 202 is removed, upper 204 may crinkle or contract slightly, as seen in FIG. 3. This configuration provides for increased comfort for a wearer, as upper 204 conforms to foot 202 in a manner similar to a sock.

Additionally, by using a flexible material, upper 204 conforms tightly to foot 202 in order to prevent excessive water from seeping through ankle collar 206. In some embodiments, to increase this feature, ankle collar 206 may include an additional elastic lining configured to close tightly around foot 202. Although water may be absorbed through upper 204 during use, excessive water may be prevented from building up because of the conforming nature of upper 204, which may help prevent slipping or chaffing of upper 204 due to excess water building up within upper 204.

Preferably, article of footwear 200 includes sole 201. In this embodiment, sole 201 may be a wrap-around sole. The term 'wrap-around sole' is used throughout the remainder of this detailed description and in the claims to refer to any sole including a periphery that extends vertically around the sides of upper 204. In this embodiment, sole 201 includes side wall periphery 210.

Additionally, in some embodiments, side wall periphery 210 may further include medial extended portion 212, lateral extended portion 214 and heel extended portion 216. Generally, portions 212, 214 and 216 may be constructed as flaps that extend further beyond side wall periphery 210. In some embodiments, portions 212, 214 and 216 may be attached directly to upper 204. In other embodiments, portions 212, 214 and 216 may not attach directly to upper 204, but may flap instead with respect to sole 201.

Preferably, heel extended portion 216 may be configured to attach directly to upper 204. Using this configuration, heel extended portion 216 may provide protection for heel 220 of article of footwear 200. Additionally, in this preferred embodiment, portions 214 and 216 are preferably not directly attached to upper 204, but instead can move independently of upper 204.

Preferably, sole 201 is made of a water resistant or waterproof material. In some embodiments, sole 201 may be made of a material configured to facilitate increased traction. In some embodiments, sole 201 may also be made of a substantially flexible material. In a preferred embodiment, sole 201 may be made of some type of rubber, including various elastomers.

In addition to sole 201 and upper 204, article of footwear 200 preferably includes toe member 230. In some embodiments, toe member 230 may be configured to attach directly to sole 201. In other embodiments, toe member 230 may be configured to attach to upper 204. In a preferred embodiment, toe member 230 may be configured to attach to both upper 204 and sole 201, simultaneously. Generally, toe member 230 may be made of any durable material including various kinds of rubber. This arrangement preferably provides additional protection to toe region 232 of article of footwear 200.

Preferably, article of footwear 200 includes provisions for fastening upper 204 and sole 201 to foot 202. In some embodiments, article of footwear 200 includes some kind of fastening straps. In a preferred embodiment, article of footwear 200 may include straps associated with a front portion and straps associated with a rear portion of article of footwear 200.

In this preferred embodiment, article of footwear 200 includes strap system 238. In some embodiments, strap system 238 may include medial fastening straps 240 and lateral fastening straps 242. Medial fastening straps 240 preferably include first front strap 244 and first rear strap 246 that are integrally formed together. Likewise, lateral fastening straps 242 preferably include second front strap 248 and second rear strap 250 that are integrally formed together.

In this embodiment, first front strap 244 is continuously formed with first rear strap 246. Also, in this embodiment, second front strap 248 is continuously formed with second rear strap 250. Using this preferred configuration may increase the support provided by straps 244, 246, 248 and 250. This configuration may also ease manufacturing and assembly.

Preferably, article of footwear 200 includes slip-resistant provisions. In some embodiments, article of footwear 200 may include a sole configured to provide extra traction in wet conditions. In a preferred embodiment, the sole may include provisions for channeling water away from article of footwear 200 in order to increase traction.

Figure 4:
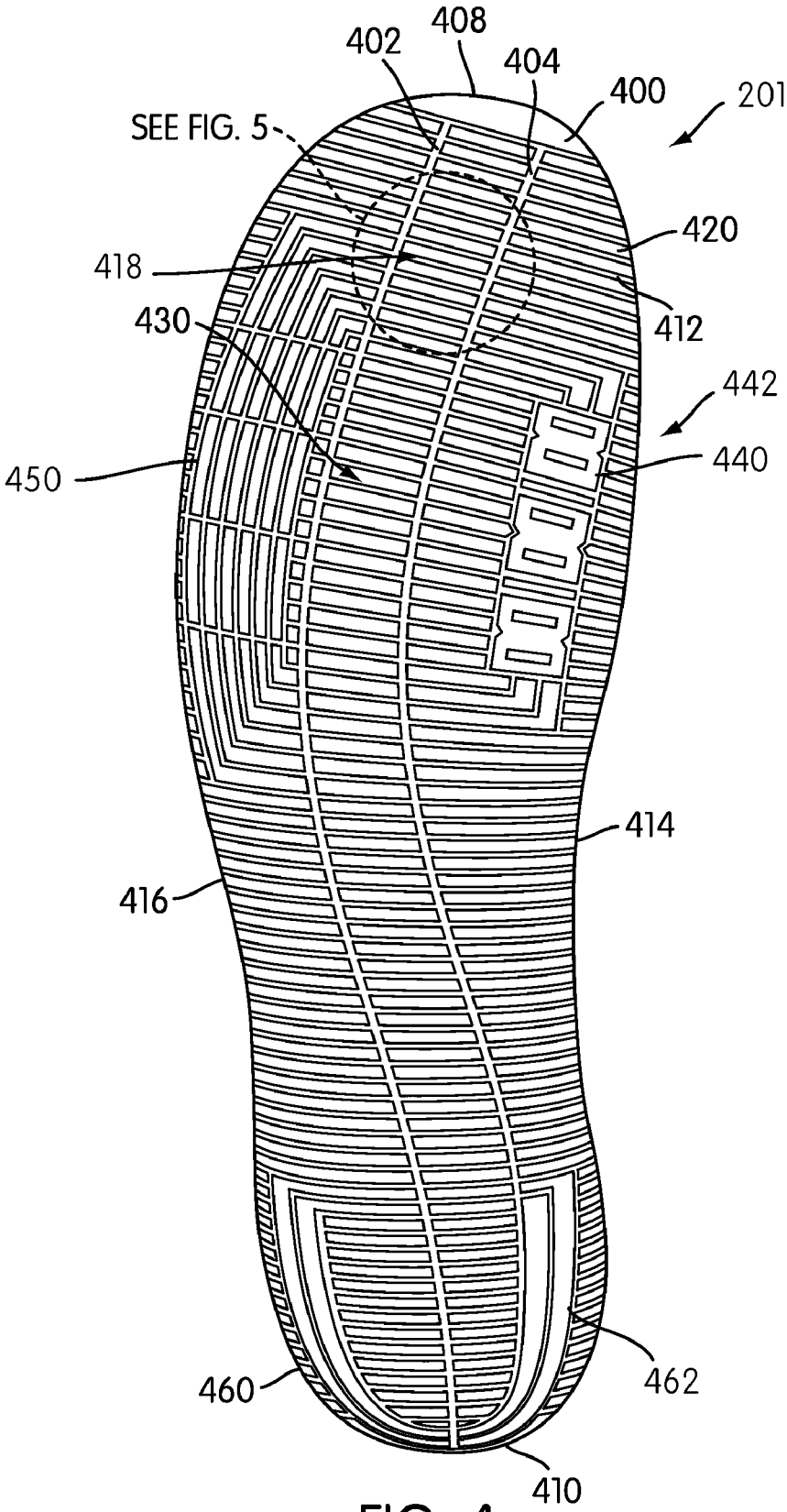
FIG. 4 is a preferred embodiment of a bottom portion of a sole of an article of footwear.

FIG. 4 is a preferred embodiment of bottom portion 400 of sole 201. Preferably, bottom portion 400 includes first central channel 402 and second central channel 404. In some embodiments, first central channel 402 and second central channel 404 may have grooves disposed in bottom portion 400. Preferably, channels 402 and 404 extend from forward end 408 to rear end 410 of bottom portion 400.

In some embodiments, bottom portion 400 may also include lateral channels 412. Preferably, lateral channels 412 extend from medial side 414 to lateral side 416 of bottom portion 400. In this preferred embodiment, lateral channels 412 may intersect central channels 402 and 404. In this embodiment, lateral channels 412 are generally perpendicular to central channels 402 and 404, however in other embodiments, lateral channels 412 could be disposed at any angle with respect to central channels 402 and 404.

Figure 5:
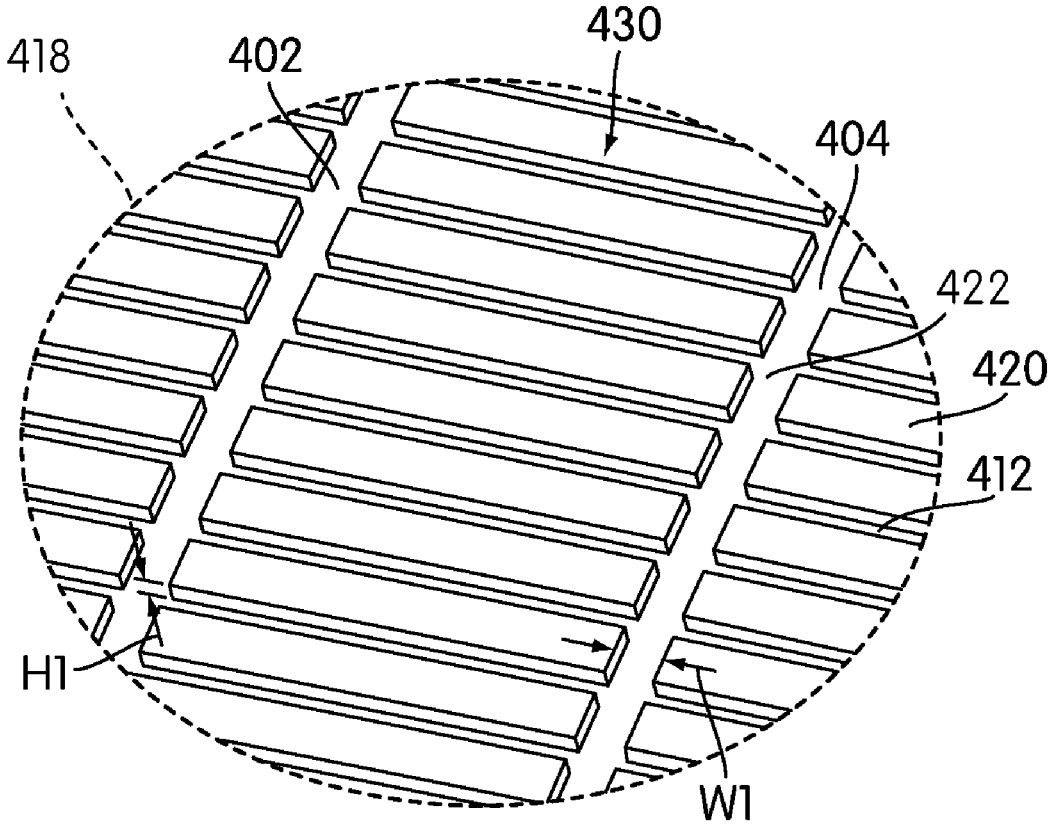
FIG. 5 is a close up view of a preferred embodiment of a portion of a bottom portion of a sole of an article of footwear.

Referring to FIG. 5, which is an enlarged view of a preferred embodiment of first portion 418 of bottom portion 400, channels 402, 404 and 412 form grooves in sole 201. In some embodiments, tread elements 420 may be disposed between channels 402, 404 and 412. In a preferred embodiment, tread elements 420 extend a height H1 above base surface 422 of bottom portion 400. In some embodiments, height H1 may range from 0.1 millimeters to 5 millimeters. In a preferred embodiment, height H1 has a value of about 1 millimeter.

Generally, the widths of channels 402, 404 and 412 may vary. In this embodiment, second central channel 404 has a width W1. Preferable, the widths of channels 402 and 412 are substantially similar to width W1 of second central channel 404. The value of width W1 may vary between 0.1 millimeters and 2 millimeters. In a preferred embodiment, width W1 has a value of about 1 millimeter.

Referring to FIGS. 4-5, central channels 402 and 404 define a central contact region 430. In particular, central contact region 430 includes the region between central channels 402 and 404. Preferably, central contact region 430 is configured to engage a surface first. If the surface is wet, water is preferably channeled away from central contact region 430 via channels 402, 404 and 412. In a preferred embodiment, water moves longitudinally through central channels 402 and 404 and laterally outwards through lateral channels 412. Using this preferred configuration, as water is generally directed out from under bottom portion 400, tread elements 420 may more easily contact the surface. This arrangement helps prevent slipping due to losses in friction caused by water disposed between tread elements 420 and the surface.

In some embodiments, sole 201 may include additional provisions for increasing traction on wet surfaces. In this preferred embodiment, bottom portion 400 also includes large recesses 440 disposed at ball region 442. Typically, a majority of weight is put on the ball of the foot. Therefore, as a wearer steps down, excess water contacting ball region 442 may be pumped away with greater efficiency through large recesses 440.

In some embodiments, bottom portion 400 may also include additional curved channels. In this preferred embodiment, bottom portion 400 may include curved channels 450. In some cases, curved channels 450 may provide additional traction during pivoting, as bottom portion 400 may rotate about ball region 442. In other embodiments, curved channels 450 may provide additional longitudinal channels for the water to move along, thus increasing the distribution to lateral channels 412.

In some embodiments, bottom portion 400 may also include provisions for increasing traction at heel region 460. To provide increased traction as the heel is lowered, heel region 460 may include U-shaped channels 462. These channels preferably facilitate the pumping of water away from heel region 460, especially at central contact region 430.

It should be understood that large recesses 440, curved channels 450 and U-shaped channels 462 are optional. In other embodiments, only some of these provisions may be incorporated into bottom portion 400. In still other embodiments, none of these additional provisions may be used. Generally, by including some of these additional provisions, the type of traction achieved may be modified. Additionally, varying height H1 associated with tread elements 420 and width W1 associated with channels 402, 404 and 412, the amount of traction may also be varied.

Using these provisions associated with sole 201, article of footwear 200 may be configured to provide increased traction on a wet surface. This feature is especially important for articles of footwear used in various sports such as canoeing, kayaking and similar paddling sports. As athlete 100 steps on boat 102, rocks or other wet surfaces, sole 201 may facilitate reduced slipping.

Preferably, article of footwear 200 includes provisions for increasing support to foot 202. Often, straps are fixed at one end to a strobel stitch or similar fastening region where an upper is attached to a sole. Preferably, in the current embodiment, strap system 238 may be attached to sole 201 at a different location from upper 204. This may facilitate increased support for foot 202 as strap system 238 may wrap some of sole 201 against foot 202.

Figure 6:
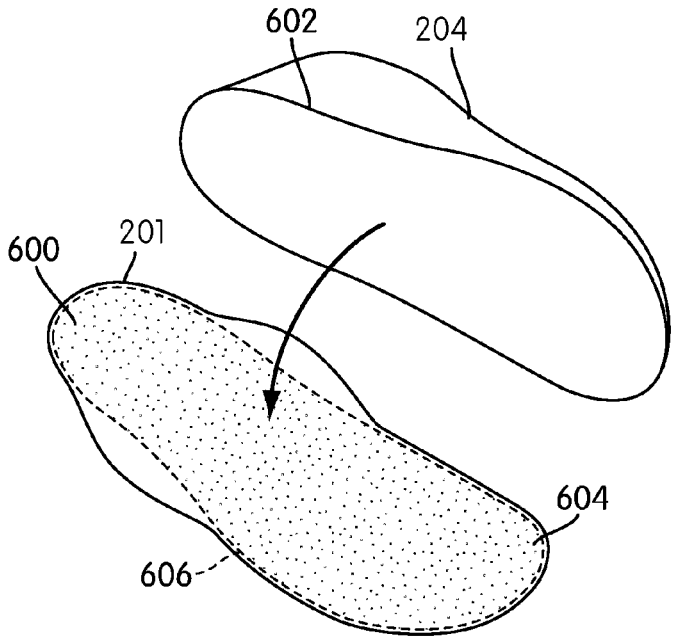
FIG. 6 is an exploded isometric view of a preferred embodiment of an upper configured to attach to a top portion of a sole of an article of footwear.

FIG. 6 illustrates a preferred embodiment of upper 204 configured to attach to top portion 600 of sole 201. In this embodiment, bottom surface 602 of upper 204 may be attached to first region 604 of sole 201. First region 604 is shaded in FIG. 6 for purposes of clarity. First region 604 preferably includes the region of sole 201 disposed inwards or proximally to first periphery 606. In a preferred embodiment, first region 604 is a generally flat region of sole 201.

Figure 7:
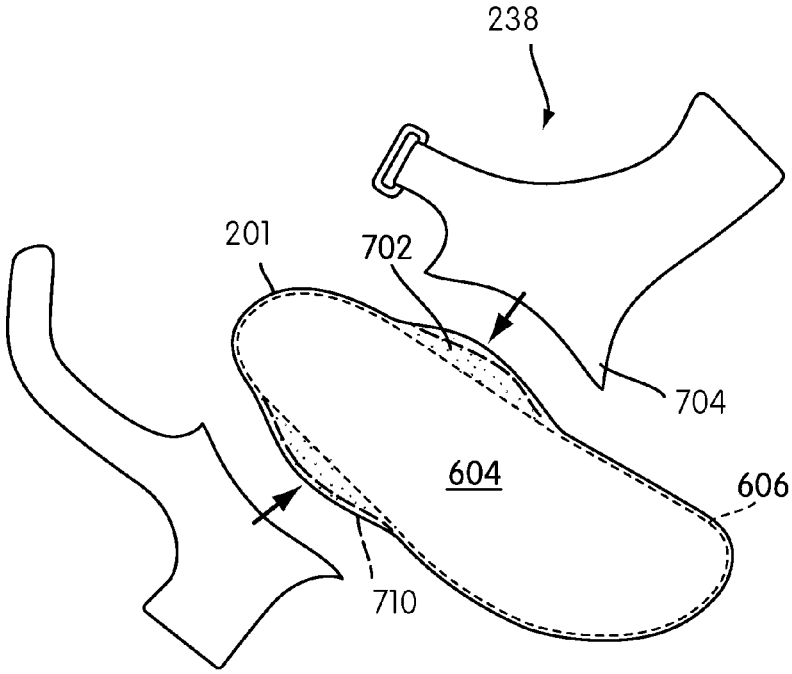
FIG. 7 is a an exploded isometric view of a preferred embodiment of a strap system and a top portion of a sole of an article of footwear.

Referring to FIG. 7, fixed ends 704 of strap system 238 may be configured to attach to extended portions 702 of sole 201. Extended portions 702 are preferably disposed outwards or distally from first periphery 606. Extended portions 702 are shaded in FIG. 7 for purposes of clarity. In a preferred embodiment, extended portions 702 generally extend at an angle with respect to first region 604, which is generally flatted.

Figure 8:
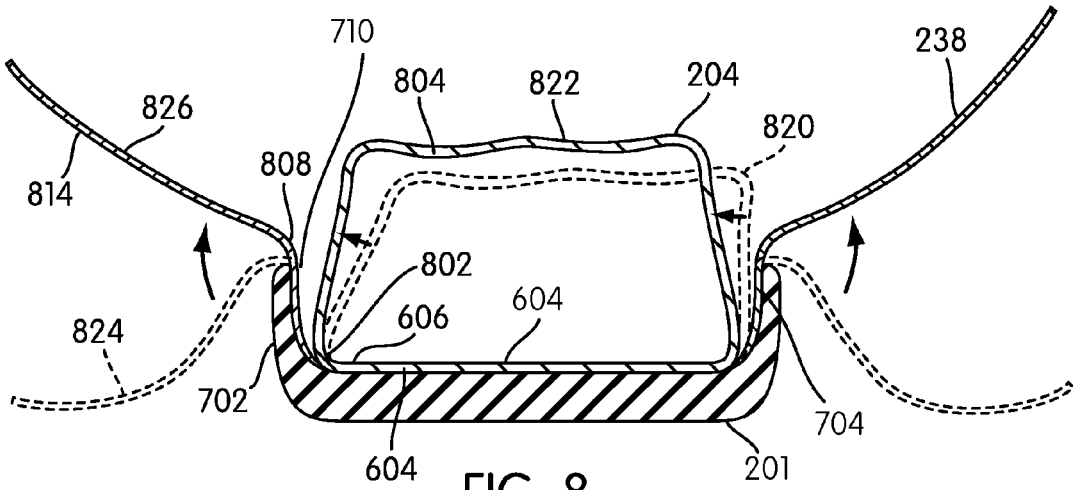
FIG. 8 is a cross sectional view of a preferred embodiment of an article of footwear.

FIG. 8 is a cross sectional view of a preferred embodiment of article of footwear 200. In this embodiment, upper 204 and strap system 238 may be associated with distinct live hinges. The term 'live hinge' refers to a connection that allows for mobility of some component on one side of the hinge. In this embodiment, upper 204 forms first live hinge 802 at first periphery 606 of sole 201. In other words, while bottom surface 602 is restricted from movement over first region 604 of sole 201, upper surface 804 of upper 204 is free to move. In particular, the movement of upper surface 804 pivots about, or hinges on first live hinge 802.

Additionally, in this embodiment, strap system 238 forms second live hinge 808 at second periphery 710 of extended portions 702 (see FIG. 7). In other words, while fixed ends 704 of strap system 238 are restricted from movement over extended portions 702 of sole 201, free portions 814 of strap system 238 are free to move. In this case, the movement of free portions 814 may pivot about, or hinge on, second live hinge 808.

FIG. 8 is also intended to illustrate the motion of upper surface 804 and free portions 814 with respect to live hinges 802 and 808, respectively. In this embodiment, upper surface 804 is initially disposed at angled position 820. Following this, upper surface 804 is repositioned to upward position 822. This repositioning may occur, for example, just prior to the insertion of the foot of athlete 100. It is clear from this Figure that upper surface 804 pivots with respect to first live hinge 802. Likewise, in this embodiment, free portions 814 are initially positioned in downward position 824. Following this, free portions 814 are repositioned to final position 826. This repositioning may occur, for example, as athlete 100 is beginning to tighten strap system 238. Although strap system 238 is attached over the entirety of extended portions 702, free portions 814 are seen to pivot with respect to second live hinge 808 in FIG. 8.

Figure 9:
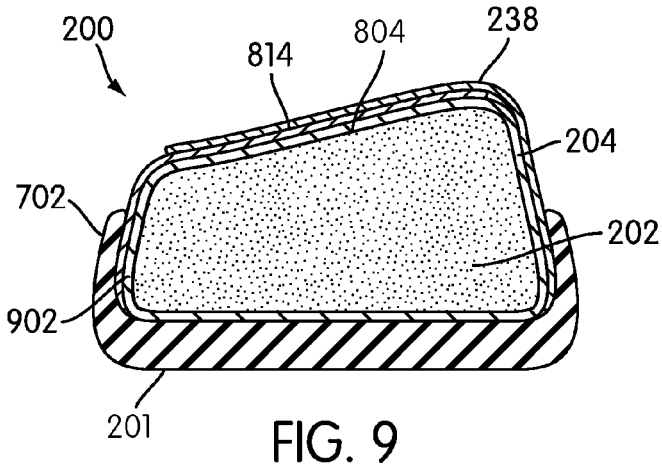
FIG. 9 is a cross sectional view of a preferred embodiment of an article of footwear with a strap system fastened.

The utility of this design may be observed in FIG. 9. In this embodiment, free portions 814 of strap system 238 have fastened around upper 204 after foot 202 has been placed into article of footwear 200. As free portions tighten against upper surface 804, extended portions 702 are pulled tightly against lower sides 902 of upper surface 804. This allows for increased stability of foot 202, which is reinforced in the region of lower sides 902. In other words, foot 202 is cradled by sole 201 for increased support. Additionally, as sole 201 is preferably water proof or water resistant as previously discussed, extended portions 702 preferably allow for increased water resistance at the base of upper 204.

Figure 10:
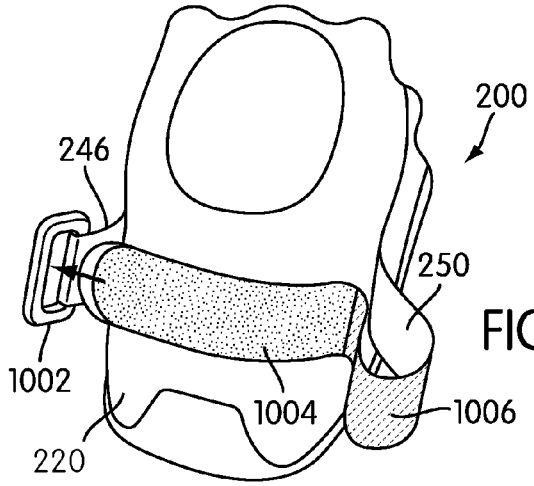
FIG. 10 is a preferred embodiment of rear straps of an article of footwear fastening around a heel.
Figure 11:
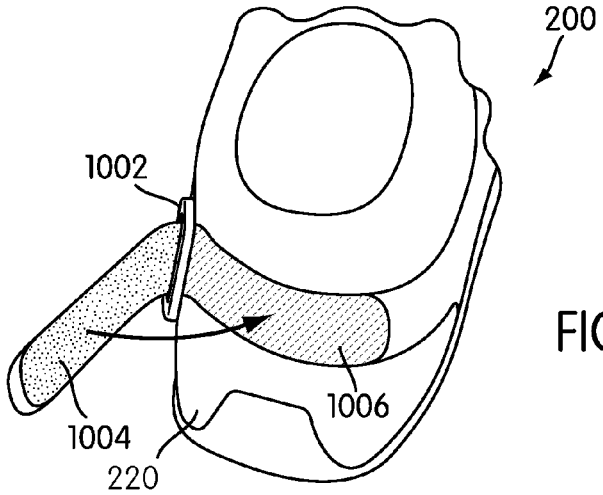
FIG. 11 is a preferred embodiment of rear straps of an article of footwear fastening around a heel.
Figure 12:
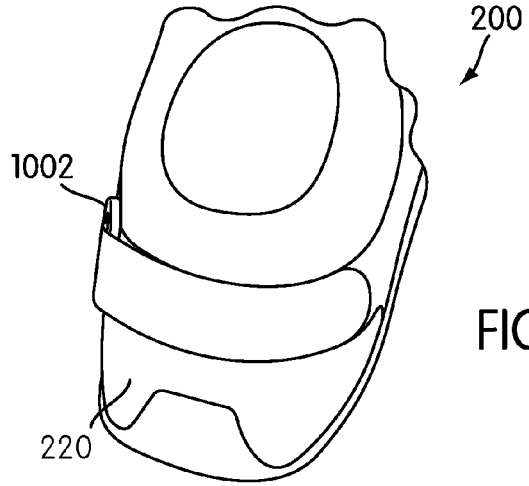
FIG. 12 is a preferred embodiment of rear straps of an article of footwear fastened around a heel.

FIGS. 10-12 are intended to illustrate a preferred embodiment of article of footwear 200 as rear straps 246 and 250 are fastened together around heel 220. Initially, second rear strap 250 is configured to be inserted through fastening loop 1002. Preferably, fastening loop 1002 is attached to the end of first rear strap 246.

Following this, second rear strap 250 may be doubled over and fastened. Preferably, second rear strap 250 includes first fastening region 1004 and second fastening region 1006. Fastening regions 1004 and 1006 may be complementary sides of a hook and loop fastener, such as Velcro®. Generally, any type of fasteners could be used.

Using this preferred configuration, second rear strap 250 may function as a cinch strap. This arrangement allows athlete 100 to quickly pull on the end of second rear strap 250 to increase tension in second rear strap 250. Preferably, such an arrangement keeps upper 204 securely fastened to a heel of athlete 100.

Figure 13:
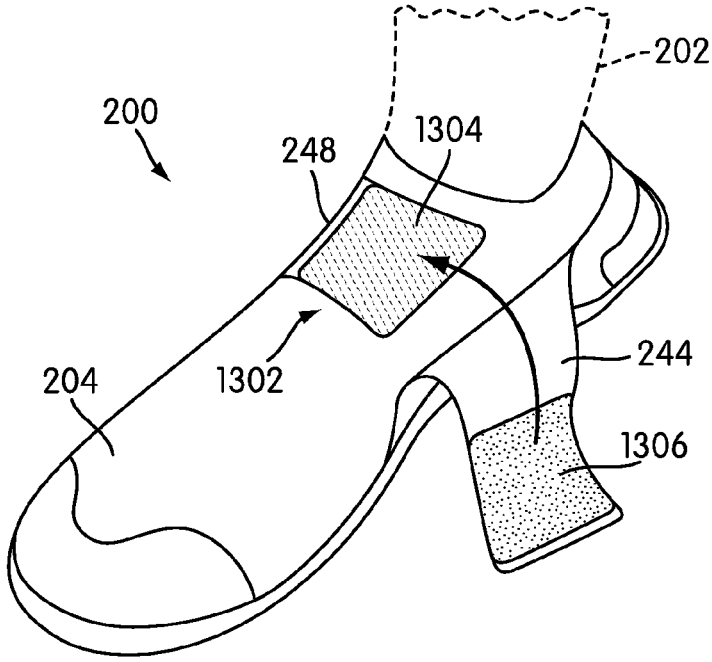
FIG. 13 is a preferred embodiment of front straps of an article of footwear fastening.
Figure 14:
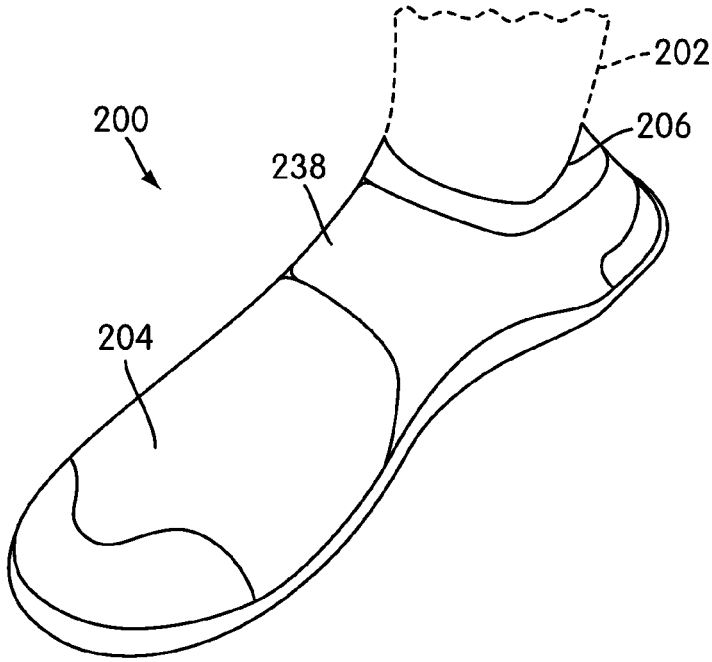
FIG. 14 is a preferred embodiment of front straps of an article of footwear fastened.

FIGS. 13-14 are intended to illustrate the fastening of front straps 244 and 248 to one another. Initially, second front strap 248 is drawn over instep region 1302 of upper 204. Preferably, second front strap 248 includes first fastener portion 1304. Following this, first front strap 244 may be folded over instep region 1302 as well. Preferably, first front strap 244 includes second fastener portion 1306. Preferably, fastener portions 1304 and 1306 may be complementary portions of a hook and loop fastener, such as Velcro®. In other embodiments, different types of fasteners may be used.

With this preferred arrangement, front straps 244 and 248 may be fastened into place at instep region 1302. This preferably tightens upper 204 to foot 202 at instep region 1302. Using straps 244, 246, 248 and 250 of strap system 238 may facilitate a tight closure of ankle collar 206 around foot 202, further decreasing the tendency of large amounts of water to splash into upper 204 and cause irritation or other problems.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear configured to provide traction on a wet surface, comprising:

a water durable upper comprising an elastic, flexible material, the water durable upper being configured to conform to contours of a foot;

a sole comprising a top surface, a vertically extending periphery and a slip-resistant bottom surface;

a strap system attached to the vertically extending periphery of the sole comprising a first front strap, a first rear strap, a second front strap and a second rear strap;

the first front strap being configured to engage the second front strap at an instep region of a foot and the first rear strap being configured to engaged the second rear strap at a heel of the foot; and wherein the first front strap is integrally formed with the first rear strap and wherein the second front strap is integrally formed with the second rear strap.

2. The article of footwear according to claim 1, wherein the upper is configured to attach to the top surface of the sole to form a first live hinge at a first periphery of the sole.

3. The article of footwear according to claim 2, wherein the vertically extending periphery further includes an extended portion and the strap system is configured to attach to the sole at the extended portion and form a second live hinge at a second periphery of the sole.

4. The article of footwear according to claim 3, wherein the second live hinge is disposed distally of the first live hinge.

5. The article of footwear according to claim 1, wherein the first rear strap and the second rear strap may be adjusted independently of the first front strap and the second front strap.

6. The article of footwear according to claim 1, wherein the sole includes channels configured to pump water out from under a bottom portion of the sole.

7. An article of footwear configured to provide traction on a wet surface, comprising:

a water durable upper comprising an elastic, flexible material;

a sole comprising a top surface, a vertically extending periphery and a slip-resistant bottom surface;

the upper including a bottom portion configured to permanently attach to the top surface of the sole and forming a first live hinge at a first periphery of the sole;

a strap system configured to permanently attach to the vertically extending periphery of the sole and forming a second live hinge at a second periphery of the sole; and wherein the second live hinge is disposed distally of the first live hinge.

8. The article of footwear according to claim 7, wherein the strap system includes a first front strap, a second front strap, a first rear strap and a second rear strap.

9. The article of footwear according to claim 8, wherein the first front strap is configured to engage the second front strap at an instep region of a foot.

10. The article of footwear according to claim 9, wherein the first rear strap is configured to engage the second rear strap at a heel of the foot.

11. The article of footwear according to claim 10, wherein the first front strap is integrally formed with the first rear strap and the second front strap is integrally formed with the second rear strap.

12. The article of footwear according to claim 7, wherein the upper and the vertically extending periphery of the sole pivot about the first live hinge and wherein the strap system pivots about the second live hinge.

13. The article of footwear according to claim 12, wherein the sole includes a central contact region and channels configured to remove water from the central contact region.

14. An article of footwear configured to provide traction on a wet surface, comprising:

a water durable upper comprising an elastic, flexible material, wherein the water durable upper is configured to conform to contours of a foot;

a slip-resistant sole;

the sole including a bottom portion;

a central contact region of the bottom portion disposed between a first central channel and a second central channel, wherein the first central channel and the second central channel extend from a forward end of the bottom portion to a rear end of the bottom portion, the central contact region having a substantially consistent medial to lateral width, between the first central channel and the second central channel; and the substantially consistent width portion of the central contact region extending from the forward end to a midfoot region of the bottom portion;

a plurality of lateral channels configured to intersect the first central channel and the second central channel, wherein the plurality of lateral channels includes a plurality of lateral channels disposed on a medial side that extend from a medial side to the second central channel, and wherein the plurality of lateral channels includes a plurality of lateral channels disposed on a lateral side that extend from a lateral side to the first central channel;

wherein a substantial majority of the plurality of lateral channels disposed on the medial side extend linearly through the second central channel, the central contact region, and the first central channel, so that the substantial majority of lateral channels extends linearly through the central contact region;

a plurality of large recesses disposed in a ball region of the bottom portion inward from a perimeter of the bottom portion on the medial side;

wherein the first central channel, the second central channel and the plurality of lateral channels are configured to pump water away from the central contact region;

and wherein the plurality of large recesses are configured for removing water from under the bottom portion.

15. The article of footwear according to claim 14, comprising three large recesses.

16. The article of footwear according to claim 15, wherein the bottom portion includes a plurality of curved channels configured for removing water from under the bottom portion.

17. The article of footwear according to claim 16, wherein the bottom portion includes a heel portion with U-shaped channels configured for removing water from under the bottom portion.

18. The article of footwear according to claim 14, wherein the sole further comprises a top surface, and wherein the upper is configured to attach to the to surface of the sole to form a live hinge at a periphery of the sole.

19. The article of footwear according to claim 1, wherein the strap system is made of an elastic material.

20. The article of footwear according to claim 19, wherein the strap system is configured to conform to contours of a foot.

* * * * *